United States Patent [19]

DeLange et al.

[11] Patent Number: 4,817,352

[45] Date of Patent: Apr. 4, 1989

[54] DISPLAY WALL SYSTEM

[76] Inventors: Daniel H. DeLange, 13220 Southwest 208th St., Miami, Fla. 33177; Ralph B. Schregardus, Hickory Center, Rt. 2, Waupun, Wis. 53963

[21] Appl. No.: 157,232

[22] Filed: Feb. 18, 1988

[51] Int. Cl.[4] ..... E04B 2/88

[52] U.S. Cl. ..... 52/235; 52/508

[58] Field of Search ..... 52/508, 510, 511, 481, 52/345, 235

[56] References Cited

U.S. PATENT DOCUMENTS

| | | | |
|---|---|---|---|
| 1,528,777 | 3/1925 | Marting | 52/245 |
| 4,064,664 | 12/1977 | Carl | 52/235 |
| 4,565,040 | 1/1986 | Kaminaga | 52/235 |
| 4,614,069 | 9/1986 | Tanikawa | 52/235 |

FOREIGN PATENT DOCUMENTS

| | | | |
|---|---|---|---|
| 2364224 | 11/1975 | Fed. Rep. of Germany | 52/235 |
| 1241861 | 8/1960 | France | 52/235 |
| 595600 | 6/1959 | Italy | 52/235 |
| 2125846 | 3/1984 | United Kingdom | 52/235 |

*Primary Examiner*—Henry E. Raduazo

*Attorney, Agent, or Firm*—Fleit, Jacobson, Cohn & Price

[57] ABSTRACT

A mounting assemblage is provided for supporting upstanding horizontally spaced apart posts in horizontally aligned and plumb positions from a wall structure, whether or not the wall structure is horizontally straight or plumb, and a display wall assembly incorporating upper, intermediate and lower height display panel sections are removably supported from the posts.

9 Claims, 2 Drawing Sheets

FIG. 1
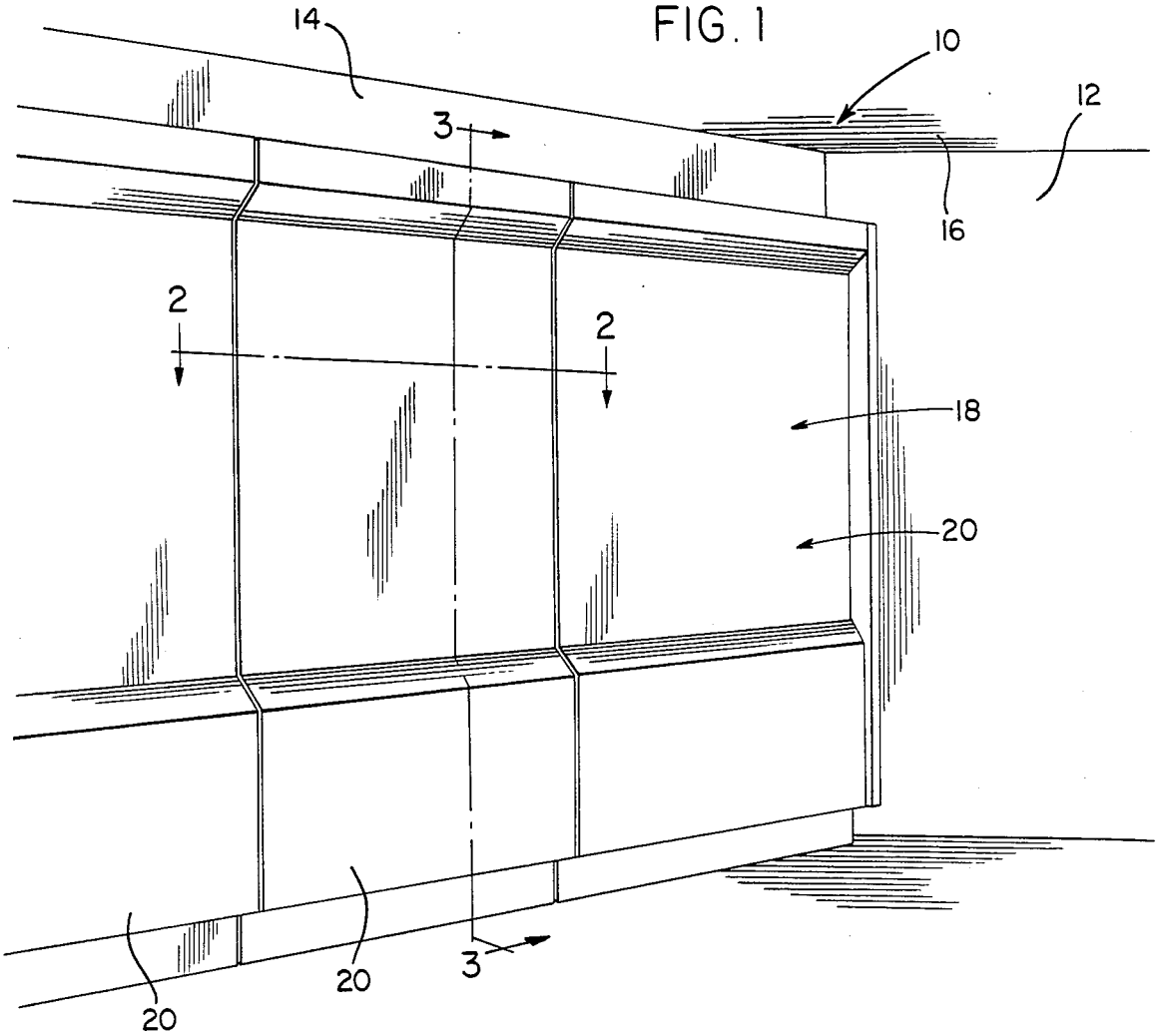
FIG. 2
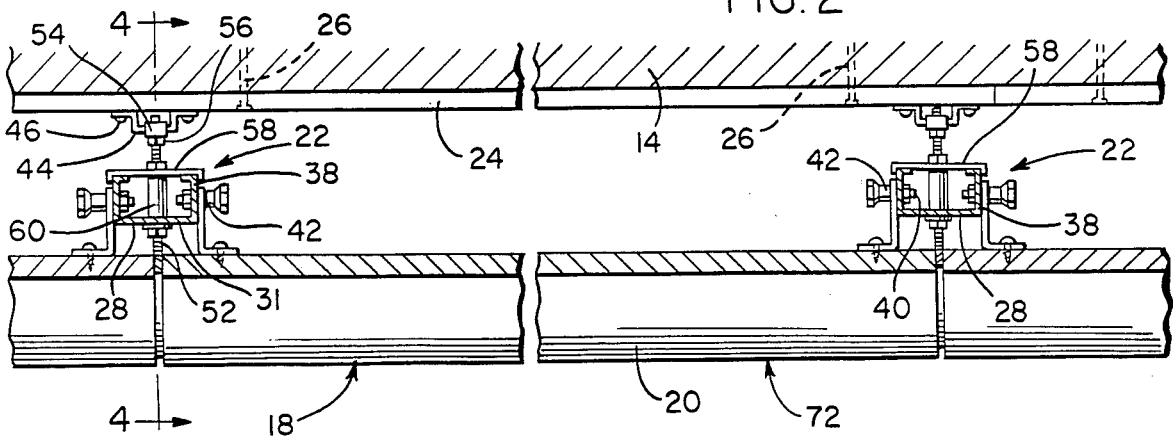
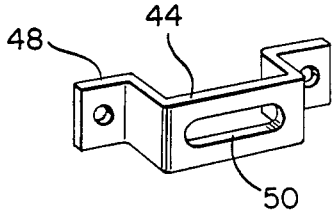
FIG. 7

DISPLAY WALL SYSTEM

BACKGROUND OF THE INVENTION

1. Field of the Invention

This invention relates incorporating display wall panels and mounting structure therefor from which the display wall panels are readily removably supported and by which the display wall panels may be mounted in planar, plumb positions from an existing wall, whether or not the existing wall is plumb or straight.

2. Description of Related Art

Various different forms of display wall systems heretofore have been provided, but most have not included structure whereby selected display wall panels may be mounted in precise aligned positions from an existing wall, whether or not that existing wall is plumb or straight.

Accordingly, there is a need for an improved form of display wall system incorporating selected display wall panels and mounting structure therefor from which the display wall panels may be readily removably supported in aligned and plumb positions an with the mounting structure being capable of adjustment to compensate for a support wall which is out of plumb and not straight.

SUMMARY OF THE INVENTION

The display wall system of the instant invention has been specifically designed for use in readily removably supporting display wall panels from existing wall structures, whether or not those wall structures are straight or plumb.

The main object of this invention is to provide a mounting structure for a display wall system from which a plurality of display wall panels may be readily removably supported in plumb and aligned positions and wherein the mounting structure for the display wall panels may be fixedly mounted from an existing wall in a manner such that the mounting structure may compensate for a mounting wall which is out of plumb and not straight.

Another object of this invention is to provide a mounting system for display wall panels and which incorporates major components commonly used in the construction of walls and in supporting panels from existing walls and additionally utilizes relatively inexpensive minor components to provide all of the adjustability features of the mounting structure.

Yet another object of this invention, in accordance with the immediately preceding object, is to provide inexpensive minor components which also function to removably support display wall panels from the display wall mounting structure.

Yet another object of this invention is to provide a display wall system which may be erected by even relatively inexperienced personnel.

A final object of this invention to be specifically enumerated herein is to provide a display wall system in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of the display wall system of the instant invention supported from an existing previously constructed wall;

FIG. 2 is a fragmentary enlarged horizontal sectional view taken substantially upon the plane indicated by the section line 2—2 of FIG. 1;

FIG. 7 is an enlarged perspective view of one of the brackets utilized to anchor the anchor structure to the corresponding wall mounted cleat.

DESCRIPTION OF THE PREFERRED EMBODIMENT

Figure 3:
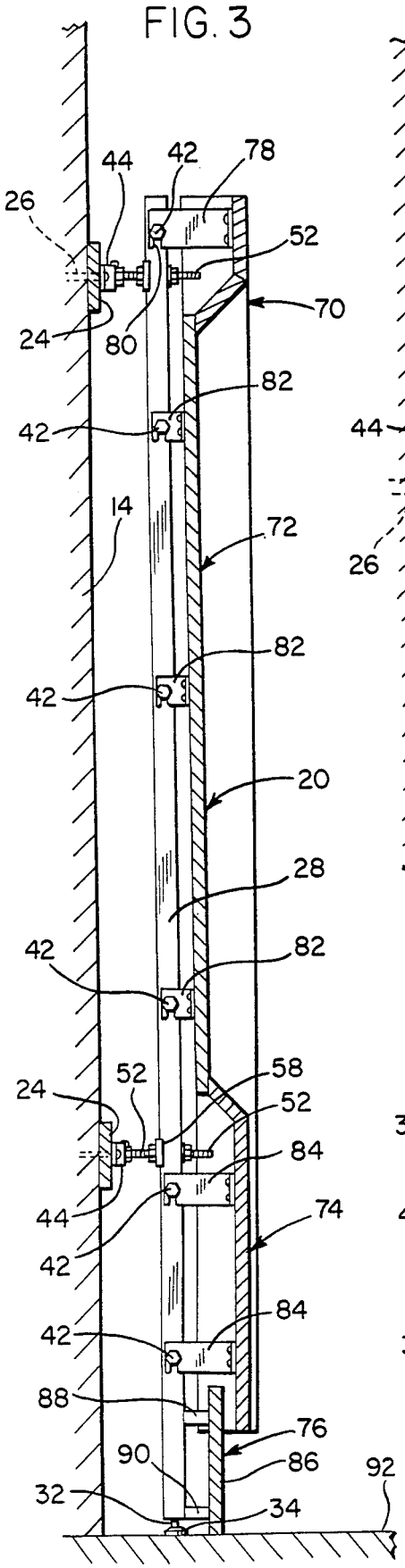
FIG. 3 is an enlarged vertical sectional view taken substantially upon the plane indicated by the section line 3-3 of FIG. 1.

Referring now more specifically to the drawings, the numeral 10 generally designates a building room area including adjacent relatively angulated walls 12 and 14 and a ceiling 16 extending between and interconnecting the upper marginal edges of the walls 12 and 14.

The display wall system of the instant invention is referred to in general by the reference numeral 18 and incorporates a plurality of side-by-side, aligned and plumb wall panel means 20 removably supported from the wall 14 through the utilization of mounting structure referred to in general by the reference numeral 22.

Figure 4:
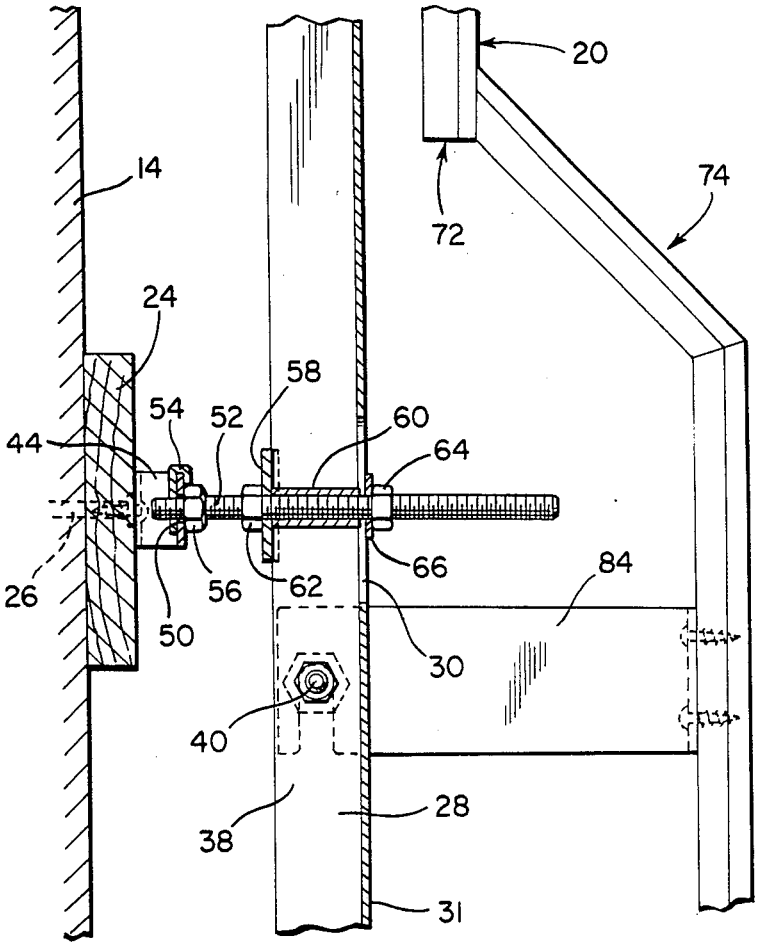
FIG. 4 is an enlarged fragmentary vertical sectional view taken substantially upon the plane indicated by the section line 4—4 of FIG. 2.

Preparatory to securement of the mounting structure 22 to the wall 14, a plurality (pair) of vertically spaced horizontal wall cleats 24 are secured to the wall 14 through the utilization of suitable fasteners 26, see FIGS. 2 and 4.

Each of the wall panel means 20 is supported from a pair of posts 28 and each post 28 may comprise a generally channel shaped metal wall stud. Each post 28 includes a pair of vertically extending and spaced upper and lower slots 30 formed through the bight portion 31 thereof and a lower end wall (not shown) through which the threaded shank 32 of a support foot 34 is threadingly engaged. Also, each post 28 has six vertically spaced bores (not shown) formed through each of the side flanges 38 thereof and the diametrically reduced threaded shank portion 40 of a headed stud 42 is secured through each of the aforementioned bores, the headed ends of the studs 42 projecting outward from the corresponding side flanges.

After the wall cleats 24 are secured to the wall 14, a pair of U-shaped brackets 44 are secured to the wall cleats 24 for each post 28, each pair of brackets 44 being substantially vertically aligned and mounted to the corresponding wall cleat 24 through the utilization of fasteners 46 secured through apertured mounting flanges 48 of the bracket 44 and relative to the wall cleat 24. Each bracket 44 includes a horizontal slot 50 formed therein and a first end of a threaded shank or mounting stud 52 is secured through each slot 50 through the utilization of a horizontally slidable nut 54 engaged with the corresponding bracket 44. The second ends of the threaded shanks a mounting studs 52 which project away from the wall 14 are received through the slots 30 formed through the bight portion 31 and an apertured channel piece 58 embracingly engages the side of each post 28 opposing a corresponding bracket 44 and receives the mounting stud 52 therethrough. In addition, a sleeve 60 is disposed on each mounting stud 52 between the inner surface of the bight portion 31 of the corresponding post 28 and the associated channel piece 58. Further, a pair of threaded abutments (nuts) 62 and 64 are threaded on the mounting studs 52 and oppose the outer surface of the corresponding channel piece 58 and a washer 66 opposing the outer surface of the slotted portion of the bight portion 31 of the corresponding post 28.

The mounting stud 52 is tightened relative to the corresponding bracket 44 and associated nut 54 through the utilization of a wrench (not shown) applied to the abutment 56 and the upper and lower ends of each post may be adjusted inwardly and outwardly relative to the wall 14 by adjustment of the abutments 62 and 64, each pair of upper and lower mounting shanks 5 being horizontally adjusted before tightening the corresponding abutment 56.

Accordingly, by horizontal adjustment of the mounting shanks 52 in the slots 50 each pair of upper and lower mounting shanks may be precisely vertically aligned. In addition, by adjustment of the abutments 62 and 64 along the mounting shanks 52 and vertical adjustment of the posts 28 relative to the mounting shank 52 the posts 28 may be mounted precise distances apart and in precise horizontal alignment with each other as well as in plumb positions.

Each wall panel means 20 incorporates an upper valance assembly referred to in general by the reference numeral 70, an intermediate height panel assembly 72 and a lower wainscot assembly 74. In addition, a lower toe base referred to in general by the reference numeral 76 is also provided.

Each horizontally elongated valance assembly 70 includes a pair of rearwardly projecting mounting brackets 78 supported therefrom and including downwardly opening notches 80 formed in the rear ends thereof in which the uppermost headed studs 42 may be received. Each intermediate height panel assembly 72 includes three vertically spaced pairs of opposite side margin supported mounting brackets 82 corresponding to the mounting brackets 78. The notched mounting brackets 82 are engageable over the second, third, and fourth from the top studs 42 supported from the post 28 and the wainscot assembly 74 includes two vertically spaced pairs of opposite side margin supported mounting brackets 84 corresponding to the mounting brackets 78 and 82 and engageable over the lower two headed studs 42 carried by each corresponding post 28.

The wainscot assembly 74 will be installed first on the posts 28 and then the intermediate height panel assembly 72 may be installed. Thereafter, the valance assembly 70 may be installed, the lower marginal portion of the valance assembly 70 merely abutting against the outer surface of the upper marginal edge of the intermediate height panel assembly 72. The toe base 76 merely comprises a vertical panel 86 having rearwardly projecting upper and lower abutments 88 and 90 supported therefrom whose rearmost extremities may abut the corresponding posts 28. Of course, the lower marginal edge of the panel 86 rests upon the floor 92 and the toe base 76 may have its upper marginal edge tilted rearwardly and displaced rearwardly beneath the lower marginal edge of the wainscot assembly 74, after which the toe base 76 may be rotated to the vertical postion thereof illustrated in FIG. 3.

Figure 5:
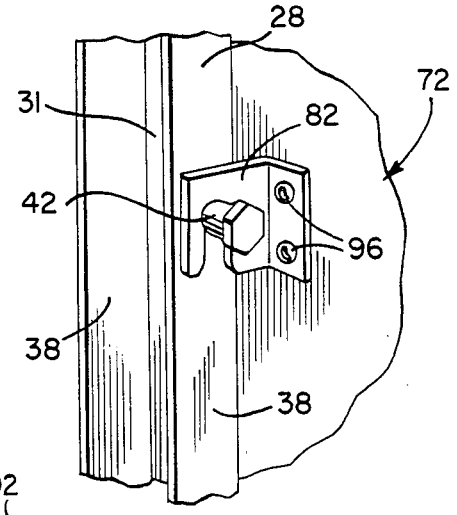
FIG. 5 is a fragmentary enlarged perspective view illustrating the manner in which display wall panels are removably supported from the mounting structure for the display wall system.
Figure 6:
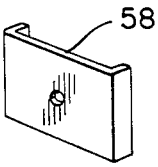
FIG. 6 is an enlarged perspective view illustrating one of the two channel members utilized to close the rear side of each post of the display system mounting structure at the corresponding point of adjustable anchoring of the post from the associated pre-existing wall.

As may best be seen from FIG. 5, the brackets 82 are supported from the intermediate height panel assembly 72 in predetermined positions thereon through the utilization of fasteners 96 and it is to be noted that the brackets 78 and 84 are similarly mounted from the valance assembly 70 and the wainscot assembly 74.

It will be noted that each of the assemblies 70, 72 and 74 may be readily removed from supported engagement on the posts 28. In this manner, various different panel assemblies may be readily interchanged. Also, it is again pointed out that the horizontal adjustability of the mounting studs 52 relative to the brackets 44, the vertical adjustment of the posts 28 to the mounting studs 52 and the in and out adjustment of the upper and lower ends of the posts 28 on the mounting studs 52 enable the mounting portions for the assemblies 70, 72 and 74 comprising the posts 28 to be precisely mounted relative to each other on the wall 14, even if the wall 14 is out of plumb and/or not planar.

It is also to be pointed out that the mounting brackets 78, 82 and 84 merely comprise simple angle members, that the channel pieces 58 may be individually cut from inexpensive channel members and that the brackets 44 may be inexpensively produced. Other than these components, the nuts 54, mounting shanks 52, sleeves 60 and incidental washers and threaded nuts in addition to the headed studs 42 comprise readily available inexpensive components. Thus, a fully adjustable mounting structure 22 is provided through the utilization of relatively inexpensive and readily available components. Furthermore, the axial extent of the cylindrical portions of the headed studs 42 with which the notched portions of the brackets 78, 82 and 84 are engaged is considerably greater than the thickness of those brackets. Therefore, the precise horizontal positioning between adjacent posts 28 is not critical.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A display wall system including a pair of wall posts for mounting in horizontal spaced apart upstanding position along a wall structure and display wall means removably supported from and spanning between said posts, a pair of upper and lower mounts for each of said posts adapted to be fixedly mounted from generally vertically spaced portions of said wall, each of said mounts including a horizontally outwardly projecting threaded shank supported therefrom for limited adjusted horizontal positioning relative to said mount, each of said posts including upper and lower vertical slots formed therein through each of which the outer end of a corresponding threaded shank is adjustably secured between a pair of axially spaced abutment members threaded on said shank, each of said posts including horizontally outwardly projecting stud extending outward from the side thereof opposing the other post, said display wall means including horizontally spaced apart vertical marginal portions, each of said marginal portions including vertically spaced mounting brackets supported therefrom removably engaged with and supported from the corresponding headed shank means.

2. The system of claim 1 wherein said vertically spaced mounting brackets defines a downwardly opening hook engageable over the corresponding stud.

3. The system of claim 2 wherein each of said studs is of an axial extent greater than the transverse thickness of the corresponding hook.

4. The system of claim 1 wherein said posts each comprise a channel member opening away from said display wall means, said posts each including a centrally apertured shallow channel piece embracingly engaged with the open side thereof through which the corresponding threaded shank projects.

5. The system of claim 4 wherein each of said channel members includes a bight portion closing the side thereof remote from the open side, said slots being formed in said bight portions.

6. The system of claim 5 including a sleeve disposed on each of said shanks intermediate the corresponding channel piece and bight portion.

7. The system of claim 6 wherein each of said mounts includes a channel shaped member including a pair of apertured mounting flanges for attachment to said wall and a web portion paralleling and laterally offset from a plane containing said flanges, each of said threaded shanks being supported from the corresponding web portion.

8. The system of claim 7 including a pair of horizontal and vertically spaced wall cleats for attachment to said wall, said mounts being anchored relative to said wall cleats.

9. The system of claim 1 wherein said display wall means comprises upper, intermediate and lower height panel structures removably supported from said studs.

* * * * *